US006234334B1

(12) United States Patent
Suarez

(10) Patent No.: US 6,234,334 B1
(45) Date of Patent: May 22, 2001

(54) SINGLE-PIECE PLASTIC LID

(75) Inventor: Fernando Suarez, Zurich (CH)

(73) Assignee: Createchnic AG, Nürensdorf (CH)

( * ) Notice: Subject to any disclaimer, the term of this patent is extended or adjusted under 35 U.S.C. 154(b) by 0 days.

(21) Appl. No.: 09/445,317

(22) PCT Filed: May 13, 1998

(86) PCT No.: PCT/CH98/00197

§ 371 Date: Mar. 15, 2000

§ 102(e) Date: Mar. 15, 2000

(87) PCT Pub. No.: WO98/55369

PCT Pub. Date: Dec. 10, 1998

(30) Foreign Application Priority Data

Jun. 4, 1997 (CH) ..... 1336/97

(51) Int. Cl.[7] ..... B65D 47/08

(52) U.S. Cl. ..... 215/237; 215/253; 215/254; 220/259; 220/266; 220/847; 222/541.5; 222/541.6

(58) Field of Search ..... 215/235, 237, 215/250, 253, 254, 330; 220/254, 259, 257, 266, 837, 847; 222/556, 541.5, 541.6, 541.9

(56) References Cited

U.S. PATENT DOCUMENTS

| | | | | |
|---|---|---|---|---|
| 5,386,918 | * | 2/1995 | Neveras et al. | 215/254 X |
| 5,392,938 | | 2/1995 | Dubach . | |
| 5,875,907 | * | 3/1999 | Lay | 215/253 |
| 6,116,441 | * | 9/2000 | Decelles et al. | 215/253 X |

FOREIGN PATENT DOCUMENTS

| | | | |
|---|---|---|---|
| 2269583 | * | 2/1994 | (GB) . |
| 94/03371 | | 2/1994 | (WO) . |

* cited by examiner

*Primary Examiner*—Nathan J. Newhouse
(74) *Attorney, Agent, or Firm*—Pauley Petersen Kinne & Fejer

(57) ABSTRACT

A single-piece plastic lid, having a lower part and a cap. The cap is connected to the lower part via a hinge. The lid has a guarantee strip to ensure that the lid cannot be opened unnoticed and that the lid cannot be removed from the container without damaging the guarantee strip. Thus, the guarantee strip has additional elements which enable a positive fit with both the lower part and the neck of the container. Corresponding positive fit elements are also provided on the container neck, for example in the form of snap-in elements.

10 Claims, 2 Drawing Sheets

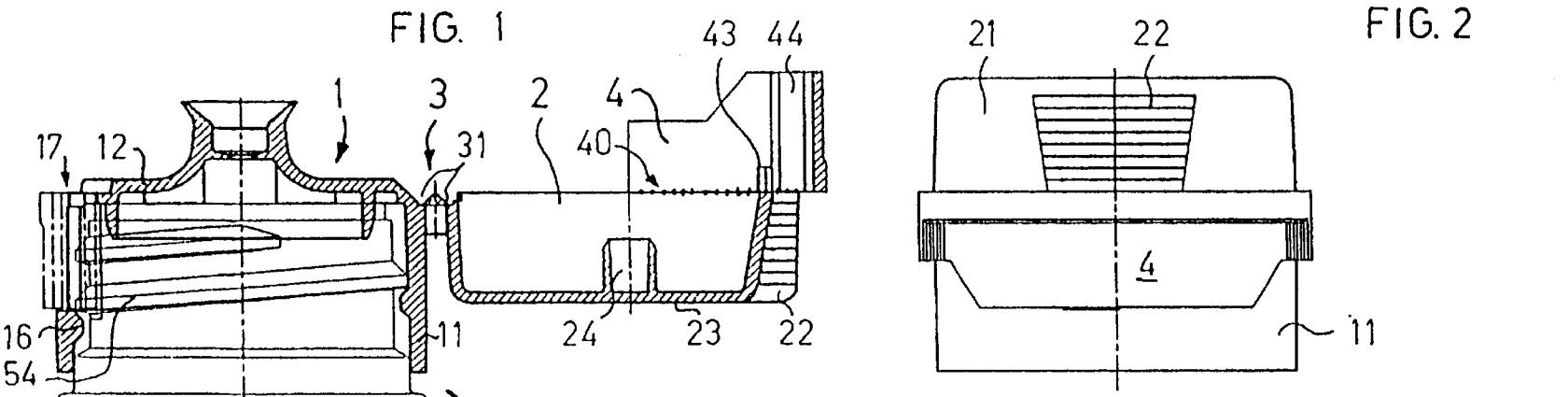
FIG. 1
1
2
3
4
5
11
12
16
17
21
22
23
24
31
40
43
44
50
54
FIG. 2
4
11
21
22
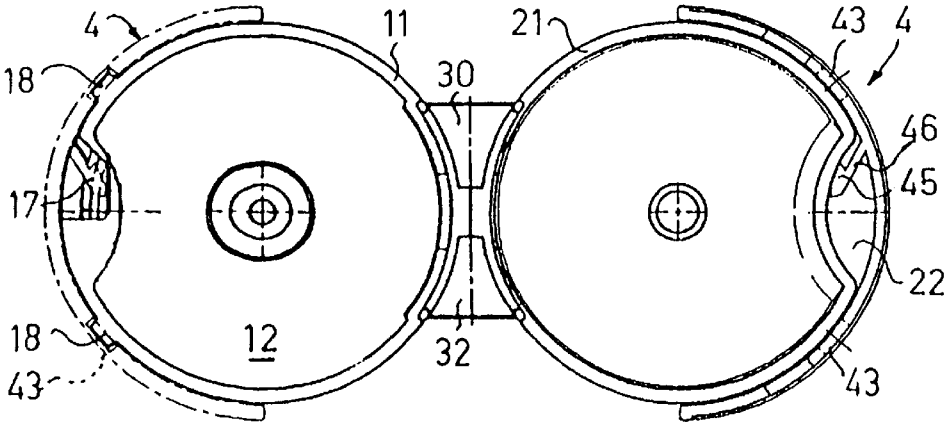
FIG. 3
4
11
12
17
18
21
22
30
32
43
45
46
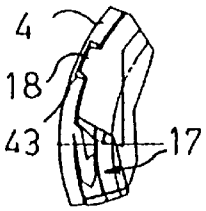
FIG. 4
4
17
18
43
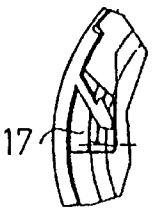
FIG. 5
17
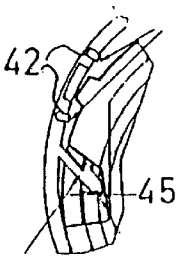
FIG. 6
42
45

SINGLE-PIECE PLASTIC LID

BACKGROUND OF THE INVENTION

1. Field of the Invention

This invention relates to a one-piece plastic closure to be fastened on a container neck, with a fastener on the container neck for the interlocking and/or frictional connection of the plastic closure with the container neck, wherein the plastic closure has a lower element and a cap pivotably connected by at least one film hinge.

2. Description of Prior Art

Increasingly greater demands are made by manufacturers for security of packaging, in particular in connection with packaging of food and cosmetics. With most current closures, depending on the type of the closure, either the connection between the closure and the container is secured appropriately, or guarantee elements are provided, which are intended to indicate intactness. While the first mentioned variation has screw closures in particular, the second mentioned embodiment mainly has a flip top. With most of the last mentioned variations, these are so-called snap hinge closures. There is a conventional plastic flip-top closure with a guarantee element described in PCT International Application WO 94/03371, wherein a guarantee element indicates whether the cap has been opened with respect to the lower element of the closure, and also indicates if, following the original closed state, the closure has been removed from the container. This solution does not use a guarantee strip, but a tear seal provided in the cap surface, which extends through the upper cover surface of the lower element and is in interlocking and frictionally-connected engagement with the fastening means on the container neck by a detent shoulder. It has been shown that this extremely elegant solution places extremely high demands on the production technology, and in the course of assembly often leads to defects, particularly of the seal. A further problem is that the destruction of the seal apparently is less obvious to the public than a customary guarantee strip when it has been torn off.

The guarantee strips of flip hinge closures are arranged on the lower element of the closure, and appropriate protrusions are arranged on the cap, which allow an interlocking connection between the cap and the guarantee strip, and therefore indirectly with the lower element. A one-piece plastic closure is known from PCT International Application WO 93/00271.

SUMMARY OF THE INVENTION

Departing from known prior art, it is one object of this invention to alter a known closure so that, without the addition of further elements, it is possible to achieve, merely with the guarantee strip, a protection of the closure against unauthorized opening, as well as against removal and subsequent replacement of the closure, as a perfect and cheap guarantee of intactness.

This object is attained by a one-piece plastic closure for fastening on a corresponding container neck, having the characteristics described in this specification and in the claims.

While present guarantee strips have always only prevented one degree of movement of a closure, namely either the possibility of a pivoting movement of the cap toward the lower element or, on the other hand, a movement component directed in the axial direction of the bottle neck for securing the closure at the container, in this invention a guarantee strip is designed such that it can perform a dual function.

BRIEF DESCRIPTION OF THE DRAWINGS

Two exemplary embodiments of the subject of this invention are shown in detail wherein:

FIG. 1 is a vertical longitudinal section view taken through a one-piece plastic closure in a completely open state and placed on top of a bottle neck;

FIG. 2 is a side view of the closure in FIG. 1 in a closed state with a view of a guarantee strip;

FIG. 3 is a top view of the same plastic closure in accordance with FIG. 1, in the same position as shown;

FIGS. 4 to 6 each show a detail of the closure in accordance with FIGS. 1 to 3 to explain the various finctions of the closure, wherein FIG. 4 shows during the placement of the closure on the container, FIG. 5 shows in the secured original position, and FIG. 6 shows during the removal of the guarantee strip;

DESCRIPTION OF PREFERRED EMBODIMENTS

Figure 7:
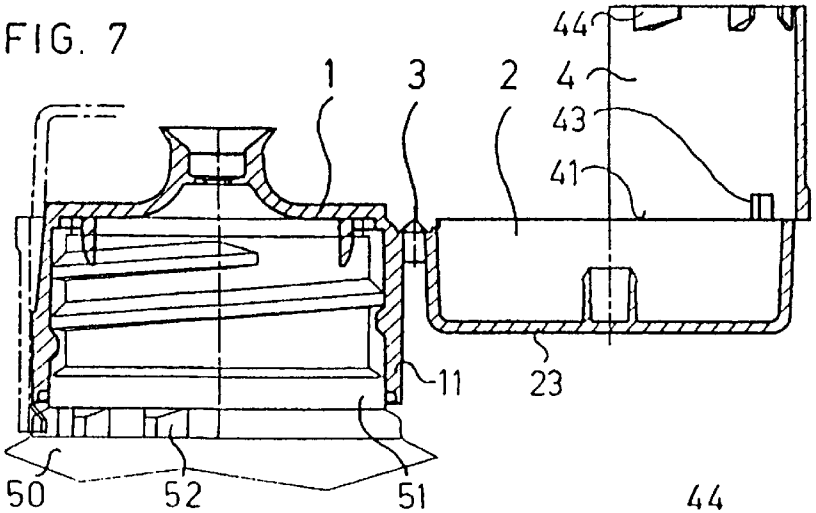
FIG. 7 is a vertical longitudinal section view taken through a completely opened plastic closure, in a second embodiment.

A typical one-piece plastic closure is shown in FIGS. 1 to 3, comprising a lower element 1 and a cap or lid 2 connected with it by means of a hinge 3. A guarantee strip 4 is attached to the lid 2. The entire closure is fastened on a container neck 5. The container neck 5 forms the outlet opening for the container 50.

The lower element 1 comprises a cylindrical casing wall 11, which is closed at the top by a cover surface 12. A nozzle 13 in the form of a spout 14 is provided in the cover surface 12. A ring-shaped wall is arranged on an underside of the cover surface 12, which forms a sealing lip 15 and, when the closure is placed, rests sealingly against an inner face of the container neck 5. Appropriate fastening means 54 are provided on the inner face of the casing wall for fixing the closure on the container neck 5. The fastening means 54 can be so-called holding beads, which are applied in a ring shape, or can be elements which are arranged on a single circle projecting inward in the form of knob. All these fastening means 54 are known in various embodiments in the prior art. In the example represented, the fastening means 54 is a screw thread.

The cap or lid 2 is arranged, hingedly connected in one piece with the lower element 1 by means of the binge 3. The cap 2 also has a cylindrical casing wall 21, which is also closed by a cover surface 23. A sealing pin 24 is attached to an inner face of the cover surface 23, which sealingly extends into the nozzle opening 13 in the closed state of the closure. In the closed state of the closure, the casing walls 11, or respectively 21, of the lower element 1 or of the cap 2, are aligned above each other. A recess, which is used as a recessed grip 22, is provided in the casing wall 21. In the area of this recessed grip 22, the casing wall 21 of the lid is not aligned with the casing wall 11 of the lower element. The hinge 3 is used to form the pivot axis 30 and comprises one or two film hinges 31, on which laterally adjoining clamping elements 32 are provided, which are used to create a snap effect.

Figure 8:
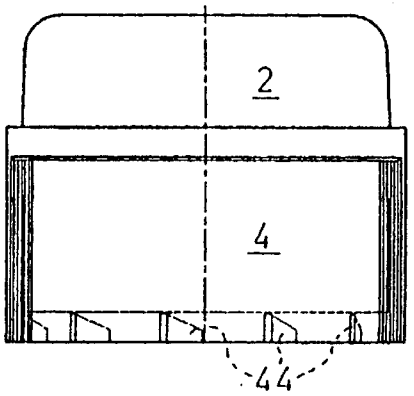
FIG. 8 is a side view of the closed closure in accordance with FIG. 7.
Figure 10:
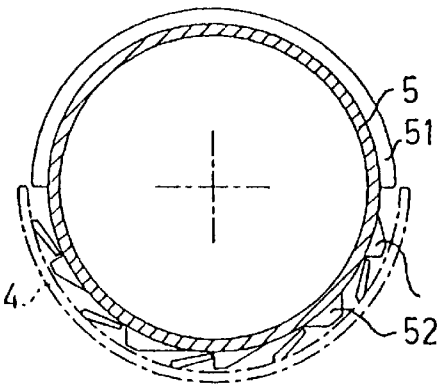
FIG. 10 is a section view taken through the container neck, which is designed to fit the closure in accordance with FIGS. 7 to 9.
Figure 9:
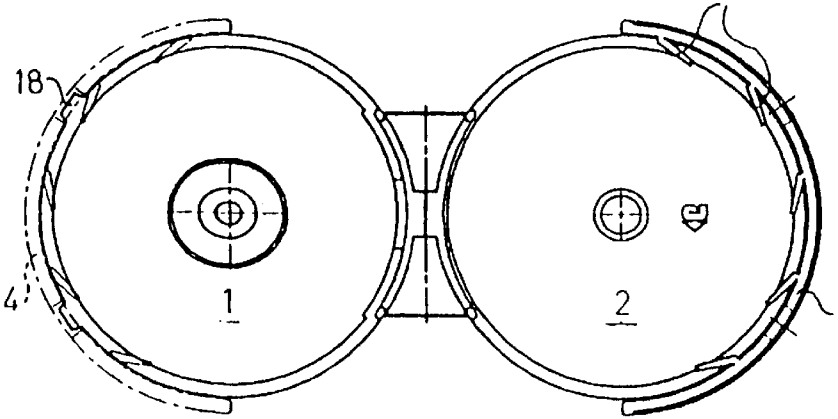
FIG. 9 is a top view of the closure in accordance with FIG. 7.

The guarantee strip 4 is fastened on the cap 2 by means of the predetermined breaking point 40. The guarantee strip 4 extends concentrically with respect to the casing wall 21 of the lid 2. Only in an area of the recessed grip 22 does the guarantee strip 4 not follow this recess. The guarantee strip 4 is essentially arranged outwardly offset by its thickness with respect to the casing wall 21 of the cap 2. The connection, which represents the so-called predetermined breaking point 40, can either be formed as a thin rip seam, or formed by a plurality of strips 42. The strips 42 are symbolically shown in FIG. 1, although normally they would not be visible in the drawings. In the embodiment of FIGS. 7 to 9, the predetermined breaking point 40 is identified as a rip seam 41. The guarantee strip 4 is arranged diametrically opposite the hinge 3. The guarantee strip 4 extends maximally over approximately one-half of the circumference of the lid 2. While the guarantee strip 4 is raised in the center, its height is symmetrically reduced laterally. In the area of the recess formed by the recessed grip 22, an additional means 44, which may have a shape of a tongue 46, is attached, pointing toward the center of the lid 2, on the guarantee strip 4. In addition, a barb 45 is formed on the tongue 46. The barb 45 extends over the entire height of the tongue 46. The tongue 46 is of the same height as the guarantee strip 4 at this location. However, in this embodiment the guarantee strip 4 is always of lesser height than the height of the casing wall 11 of the lower element 1. Accordingly, the opening 17 in the lower element 1, directed downward from the cover surface 12, is not so long that the casing wall 11 is pierced.

Figure 11:
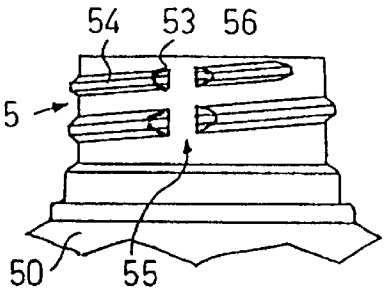
FIG. 11 is a front view of a container neck designed to fit the closure.

When first closing the closure, the tongue 46 on the guarantee strip 4 is inserted into the opening 17 in the lower element 1 in the course of the pivot movement of the cap 2 around the hinge 3. Once the cap 2 is completely pushed sealingly on the lower element 1, nose-shaped protrusions 18, which are arranged on the outer casing wall 11 of the lower element 1, engage the interlocking recesses 43 at the upper edge of the guarantee strip 4. The nose-shaped protrusions 18 on the casing wall 11 are arranged approximately flush with the upper edge of the casing wall 11. The closure is delivered to a bottler in this closed state, as shown in FIG. 2. The bottler fills the respective containers and then screws the closed closure on the container neck 5. The container neck 5 has a depression on its periphery as the interlocking means. This depression can be practically designed in such a way that the screw thread or the fastening means 54 on the container neck 5 is disrupted by a sharp edge at least on the one side and in this way cooperates with the tongue 44 on the guarantee strip 4. Such a container neck is shown in FIG. 11. The screw thread on the container neck 5 can be clearly seen. The screw thread is interrupted in the area 55, so that it has a sharp-edged shape on the one side, which forms the actual interlocking means 53. But the interrupted screw thread again rises in a ramp-shape to the original height at the point 56. This design makes it possible to screw the closure on in a screw-on direction without the tongue 44 working together here with the interlocking means 53 in a locking way, while in the unscrewing direction the tongue 44 comes into contact with the sharpedged interruption and in this way makes unscrewing impossible. This is shown in detail in FIGS. 4 to 6. It can be seen in FIG. 4 that the tongue 44 slides over the screw thread, represented in hatching, with the barb 45. Because of the opening 15 provided in the lower element 1, this can be seen in the top view on the closure. The recess 43 in the guarantee strip 4 is also clearly seen here, as well as the nose-shaped protrusion 18, which engages the interlocking recess 43. Because of the matched screw threads on the closure and the container neck 5, in the completely screwed-on state, as shown in FIG. 5, the tongue 44 rests in the area of the interlocking means 53. In this way it is also assured that the guarantee element 4 cannot be destroyed by screwing it in too far. If, however, it is intended to unscrew the closure, as shown in FIG. 6, the tongue 53 comes to rest against the interlocking means 53. But at the same time the barb 45 still engages the lower element 1, so that complete locking occurs. Only if the guarantee strip 4 is torn off and the strips 42 are destroyed in the process, can the tongue 44 be moved out of its guarantee position.

While with the solution just described, the additional means in accordance with this invention on the guarantee strip passes through the casing wall 11 of the lower element 1 of the closure, wherein in the guarantee position an interlock between the guarantee strip 4 and the lower element 1, there is an interlock between the additional means on the guarantee strip 4 and the container neck 5, as well as the lower element 1 of the closure. The embodiment in accordance with FIGS. 7 to 10 has the same solution in accordance with this invention, but this is achieved by different means. The general structure of the closure is nearly identical. This closure also comprises a lower element 1 and a cap 2, connected in one piece with it by means of a hinge 3. The guarantee strip 4 is again arranged on the cap 2 via a predetermined breaking point, which here is designed as a rip seam 41, offset outward on the lower edge of the cap 2 at least approximately by the thickness of the guarantee strip 4. However, in contrast with the previously described solution, the guarantee strip 4 is arranged higher than the height of the casing wall 11 of the lower element 1. Several inwardly projecting cams 44 are formed on the lower edge of the guarantee strip 4 as additional means. The interlocking recesses 43 along the upper edge of the guarantee strip 4 are also still provided. In the completely open position in accordance with FIG. 7, these means can be seen, naturally rotated by 180°, since in this state the lower edge of the guarantee strip 4 is on top in the drawings. In the closed position of the closure, partially drawn in dashed lines, the lower edge of the guarantee strip 4 projects past the casing wall 11 of the lower element 1, and the cams 44 can project underneath the casing wall 11 of the lower element 1. In the transition area to the container 50, the container neck 5 has a collar 51, on which snap-in means 52 are arranged at least along a half of the circumference. These sawtooth-shaped snap-in means make it possible to screw the already closed closure onto the container neck 5 of the container 50. The cams 44, already mentioned as additional means, can be designed as inwardly directed lamellas, which can be moved in a ratchet-like manner in the screw-on direction over the sawtooth-shaped snap-in means 52, while this is not possible in the screwing direction. Therefore, on the one hand the lid 2 can be opened only by removing the guarantee strip 4, and on the other hand the entire closure can be unscrewed, or respectively removed, from the container neck 5. With this solution it is possible to produce closures without problems which, in place of a screw thread, have a so-called snap-on bead. In such a case it is no longer necessary that the additional means designed as the cams 44 are designed as flexible lamellas, but instead they can be made relatively rigid and can be practically directed toward the interior. However, this is an absolutely known equivalent solution for one skilled in the art. In contrast to the previously mentioned solution, this variation can also be produced without problems in connection with relatively large closures. With smaller closures, the variation in accordance with FIGS. 1 to 6 is rather preferred.

The general inventive principle has of course also been retained in this solution. While present guarantee strips 4 always provided only the interlocked connection between the lower element 1 and the cap 2, it is possible here, because of the appropriate additional means on the guarantee strip 4, to make the connection between the guarantee strip 4 and the container 50, or respectively the container neck 5, at the same time. Therefore a plastic closure is offered which, without additionally produced parts or an additional assembly process, is in a position of providing a real guarantee of intactness. It is not only assured that the closure cannot be opened prior to first use, but also the closure cannot be removed unnoticed from the container 50 and therefore cannot be manipulated on the goods. This assurance could not practically be achieved with the known closures with guarantee strips 4 without an added outlay.

What is claimed is:

1. In a container (50) with a container neck (5) and a one-piece plastic closure (1, 2) fastened on the container neck (5), wherein fastening means (54) for at least one of interlocking and frictional connection of the plastic closure on the container neck (5) are provided on the container neck (5), wherein the plastic closure has a lower element (1) and a cap (2) pivotably connected with the lower element (1) by at least one hinge (3), and a guarantee strip (4) indicating intactness which is applied on the cap (2) by way of a predetermined breaking point and maximally extends around a half of a circumference of the cap (2), and protrusions (18) are provided on the lower element (1), which engage with recesses (43) in the guarantee strip (4) during a first closing, the improvement comprising: the guarantee strip (4) having means (44, 46) for simultaneously providing an at least interlocked connection between the guarantee strip (4) and the lower element (1) and between the guarantee strip (4) and the container neck (5).

2. In the container and plastic closure in accordance with claim 1, wherein a tongue (46) is arranged on the surface of the guarantee strip (4) oriented toward a center which in an original state is in operational connection with the container neck (5) through an opening (17) in the lower element (1).

3. In the container and plastic closure in accordance with claim 2, wherein the tongue (46) is arranged on the guarantee strip (4) at least approximately diametrically opposite the hinge (3) between the lower element (1) and the cap (2).

4. In the container, and plastic closure in accordance with claim 2, wherein the opening (17) in the lower element (1) is a slit which extends at least approximately over a height of the guarantee strip (4) and approximately parallel with a center axis of the closure, and the guarantee strip (4) completely covers the strip (17) in the original state.

5. In the container and plastic closure in accordance with claim 2, wherein a groove oriented parallel with a center axis of the container neck (5) from an exterior toward the center is on the container neck (5), and the tongue (44) on the guarantee strip (4) interlockingly enters the groove in the original state of the closure on the container (50).

6. In the container and plastic closure in accordance with claim 5, wherein the container neck (5) has a screw thread (54) and the groove is formed by an interruption (35) of the screw thread (54).

7. In the container and plastic closure in accordance with claim 2, wherein the tongue (44) has a barb (45).

8. In the container and plastic closure in accordance with claim 1, wherein the guarantee strip (4) is higher than the casing wall (11) of the lower element (1) extending around the container neck (5) and has interlocking means (44) on a lower rim which extend below the casing wall (11) of the lower element (1), and in the original state are engaged with corresponding snap-in means (52) on the container neck (5).

9. In the container and plastic closure in accordance with claim 8, wherein the interlocking means (44) on the guarantee strip (4) are snap-in lamellas projecting from the guarantee strip (4) toward a center of the closure with respect to an inner surface of the guarantee strip (4).

10. In the container and plastic closure in accordance with claim 8, wherein the container neck (5) has a radially extending annular bead projecting toward an exterior underneath which the interlocking means (44) on the guarantee strip (4) extend in the original state.

* * * * *